US010556318B2

(12) United States Patent
Yoshida et al.

(10) Patent No.: US 10,556,318 B2
(45) Date of Patent: Feb. 11, 2020

(54) AUTOMATIC GRINDING APPARATUS

(71) Applicant: OKAMOTO MACHINE TOOL WORKS, LTD., Gunma (JP)

(72) Inventors: Yutaka Yoshida, Gunma (JP); Takuo Hirayama, Gunma (JP); Kuniyoshi Matsuoka, Gunma (JP); Shiho Satake, Gunma (JP); Yoshimi Kito, Gunma (JP)

(73) Assignee: OKAMOTO MACHINE TOOL WORKS, LTD., Gunma (JP)

( * ) Notice: Subject to any disclaimer, the term of this patent is extended or adjusted under 35 U.S.C. 154(b) by 253 days.

(21) Appl. No.: 15/680,902

(22) Filed: Aug. 18, 2017

(65) Prior Publication Data

US 2018/0056481 A1 Mar. 1, 2018

(30) Foreign Application Priority Data

Aug. 25, 2016 (JP) ..... 2016-164505
Jun. 12, 2017 (JP) ..... 2017-115080

(51) Int. Cl.

| | |
|---|---|
| ***B24B 49/10*** | (2006.01) |
| ***B24B 49/12*** | (2006.01) |
| ***B24B 51/00*** | (2006.01) |
| ***B24D 5/00*** | (2006.01) |
| ***B24B 49/00*** | (2012.01) |

(52) U.S. Cl.

CPC ..... *B24B 49/12* (2013.01); *B24B 49/00* (2013.01); *B24B 49/10* (2013.01); *B24B 51/00* (2013.01); *B24D 5/00* (2013.01)

(58) Field of Classification Search

CPC ..... B24B 49/00; B24B 49/10; B24B 49/12; B24B 51/00

USPC ..... 451/5, 9, 10, 11

See application file for complete search history.

(56) References Cited

U.S. PATENT DOCUMENTS 4,499,690 A * 2/1985 Kilb ..... B24B 7/02 451/160
5,076,022 A * 12/1991 Ohta ..... B24B 51/00 451/10
5,323,572 A * 6/1994 Guenin ..... B24B 47/22 29/39
5,558,557 A * 9/1996 Dashevsky ..... B23Q 1/623 451/10
5,562,523 A * 10/1996 Asano ..... B24B 49/04 451/1

(Continued)

FOREIGN PATENT DOCUMENTS

JP 2003-326445 11/2003

*Primary Examiner* — Eileen P Morgan
(74) *Attorney, Agent, or Firm* — Rankin, Hill & Clark LLP

(57) ABSTRACT

An automatic grinding apparatus includes: a grinding wheel configured to grind a workpiece; a support configured to support the workpiece; a feeding device configured to change a relative position between the grinding wheel and the workpiece; and a control device configured to, before processing using the grinding wheel is started, calculate a range in which the grinding wheel and the support are relatively moved on the basis of information on positions of the workpiece and the grinding wheel detected by a first detector, a second detector, and a third detector, move the grinding wheel or the support by performing numerical control with respect to the feeding device, and automatically start the processing using the grinding wheel.

8 Claims, 9 Drawing Sheets

(56) References Cited

U.S. PATENT DOCUMENTS

| | | | | | |
|---|---|---|---|---|---|
| 5,562,526 | A * | 10/1996 | Yoneda | B24B 49/14 | 451/10 |
| 5,573,443 | A * | 11/1996 | Yasuda | B23Q 1/26 | 451/11 |
| 5,773,731 | A * | 6/1998 | Sakakura | B24B 49/14 | 73/865.8 |
| 7,690,967 | B2 * | 4/2010 | Makiuchi | B24B 5/04 | 451/11 |
| 2011/0097971 | A1 * | 4/2011 | Kumeno | B24B 5/04 | 451/5 |
| 2012/0028543 | A1 * | 2/2012 | Tano | B24B 1/00 | 451/5 |
| 2013/0130593 | A1 * | 5/2013 | Kalenian | B24B 49/00 | 451/5 |

* cited by examiner

AUTOMATIC GRINDING APPARATUS

CROSS-REFERENCE TO RELATED APPLICATION

This application claims priority from Japanese Patent Application Nos. 2016-164505 filed on Aug. 25, 2016 and 2017-115080 filed on Jun. 12, 2017 with the Japan Patent Office the entire contents of which are hereby incorporated by reference.

BACKGROUND

1. Technical Field

The present disclosure relates to an automatic grinding apparatus.

2. Description of the Related Art

Conventionally, there is an automatic grinding apparatus for automatically grinding a workpiece by moving a grinding wheel or the workpiece with numerical control. An automatic grinding apparatus of this kind includes an operation panel for allowing an operator to input an instruction regarding processing. Before grinding is started, the operator inputs and sets various processing conditions, such as a size and position of a workpiece, a position of the grinding wheel, and a range in which the grinding wheel and the workpiece are relatively moved, via the operation panel.

For example, JP-A-2003-326445 discloses an NC grinding apparatus for grinding a workpiece on a table. In this apparatus, an operator performs so-called teaching operation to set a dress point, a right reversed end, a left reversed end, and a left end. The NC grinding apparatus in the same literature includes a table operation panel and right and left manual pulse handles. In setting of a table position, the operator moves the table by turning the right and left manual pulse handles and stops the table at a position to be set. Then, when the operator presses any one of a dress point button, a right reversed end button, a left reversed end button, and a left end button while pressing a data setting input button of the table operation panel, a current position of the table is input to the NC grinding apparatus.

Further, the NC grinding apparatus in the same literature includes a grinding-wheel-spindle vertical-feed manual pulse handle and a grinding-wheel-spindle vertical-feed manual-pulse-handle feed amount selector switch. The operator sets a moving amount for one pulse by using the grinding-wheel-spindle vertical-manual-feeding manual-pulse-handle magnification switching switch. Furthermore, the operator adjusts a position of the grinding wheel by vertically moving a grinding wheel spindle by using the grinding-wheel-spindle vertical-manual-feeding manual pulse handle.

SUMMARY

An automatic grinding apparatus includes: a grinding wheel configured to grind a workpiece; a support configured to support the workpiece; a feeding device configured to change a relative position between the grinding wheel and the workpiece by moving the grinding wheel or the support; a first detector configured to detect a position of the workpiece in a cutting direction of the grinding wheel; a second detector configured to detect a position of the workpiece in a feeding direction vertical to the cutting direction; a third detector configured to detect a position of the grinding wheel; and a control device configured to, before processing using the grinding wheel is started, calculate a range in which the grinding wheel and the support are relatively moved on the basis of information on the positions of the workpiece and the grinding wheel detected by the first detector, the second detector, and the third detector, move the grinding wheel or the support by performing numerical control with respect to the feeding device, and automatically start the processing using the grinding wheel.

DESCRIPTION OF THE EMBODIMENTS

Figure 1:
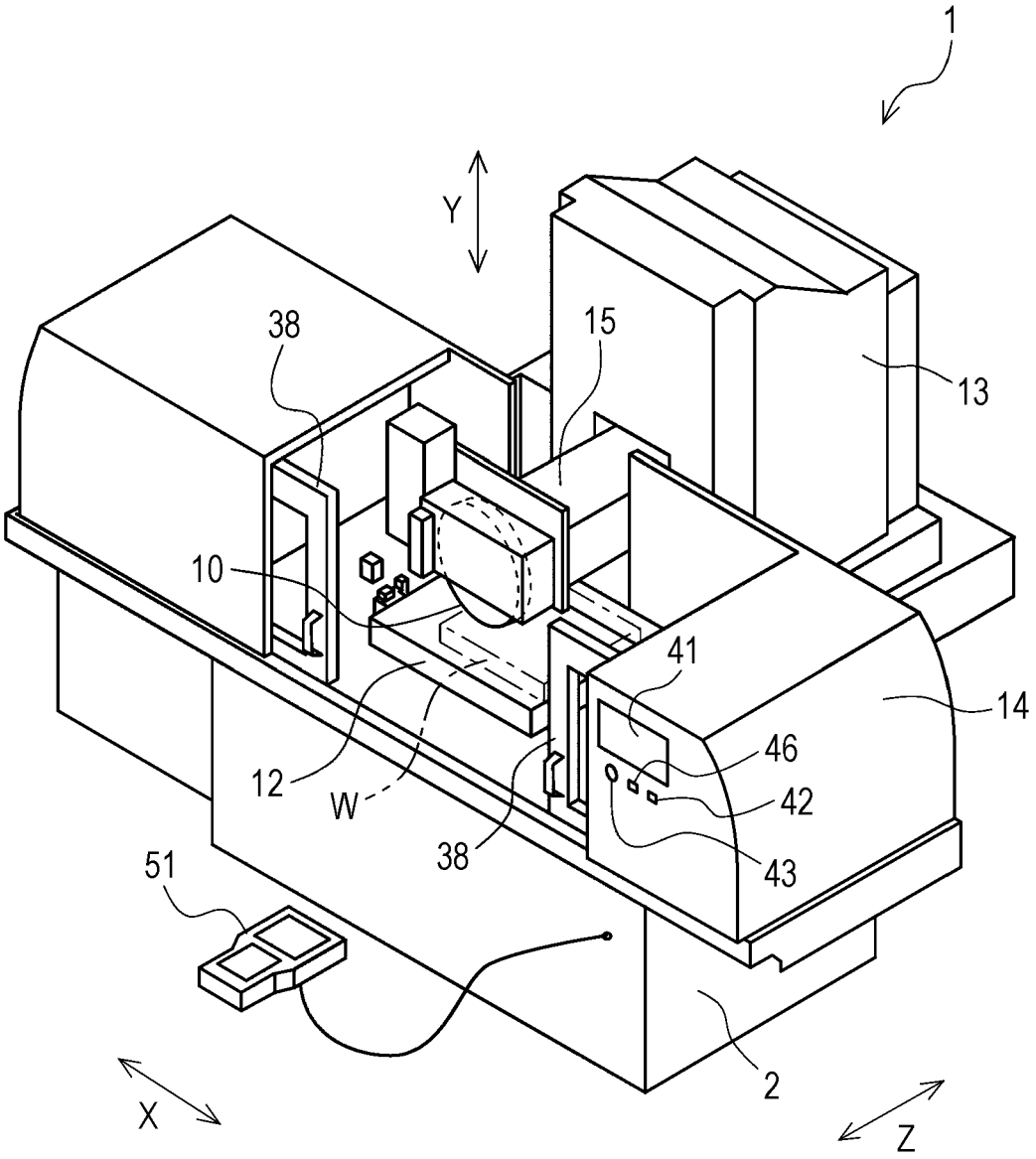
FIG. 1 is a perspective view illustrating an outline of an automatic grinding apparatus according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and apparatus are schematically shown in order to simplify the drawing.

In a method in which an operator sets a position of a table by operating a table operation panel and right and left manual pulse handles as in the related art described above, teaching operation is complicated, and therefore it takes time to perform the operation. Therefore, it is demanded to facilitate the teaching operation, reduce operation time of an operator, and improve production efficiency.

Further, operation for adjusting a position of a grinding wheel needs skill. Therefore, in a case where an inexperienced operator performs operation for setting the position of the grinding wheel, it takes a long time to perform the operation, and, in addition, an error may occur in setting of the position. Furthermore, in a case where an operator is inexperienced, the operator collides the grinding wheel with a workpiece or the like, and therefore the workpiece or the like may be ground to a degree to which the workpiece or the like is not restorable. Furthermore, in this case, the operator may also break the grinding wheel.

Further, in the automatic grinding apparatus in the related art, a large number of operation buttons and the like are provided on the operation panel. Therefore, it is not easy to operate the automatic grinding apparatus. Thus, in a case where an operator is inexperienced, erroneous operation or the like caused by the operator may occur. In view of this, an automatic grinding apparatus that can be easily operated at the time of grinding processing is demanded.

Further, in the automatic grinding apparatus in the related art, a display portion or the like displays a condition, a state, and/or the like of grinding processing. This display portion or the like is provided only on a main body of the automatic grinding apparatus, the operation panel adjacent to the main body, or the like. Therefore, it is difficult for an operator to check the state or the like of the grinding processing in a location distant from the automatic grinding apparatus, and thus it is difficult to leave from the automatic grinding apparatus during the grinding processing.

An object of the present disclosure is to provide an automatic grinding apparatus capable of automatically starting grinding processing with simple operation, without causing an operator to perform teaching operation and the like.

Further, another object of the present disclosure is to provide an automatic grinding apparatus capable of automatically preparing an optimal grinding processing condition.

Further, another object of the present disclosure is to provide an automatic grinding apparatus that allows an operator to perform operation for grinding processing, monitoring of processing information, and the like from a distant position.

An automatic grinding apparatus according to an aspect of the present disclosure (the present automatic grinding apparatus) includes: a grinding wheel configured to grind a workpiece; a support configured to support the workpiece; a feeding device configured to change a relative position between the grinding wheel and the workpiece by moving the grinding wheel or the support; a first detector configured to detect a position of the workpiece in a cutting direction of the grinding wheel; a second detector configured to detect a position of the workpiece in a feeding direction vertical to the cutting direction; a third detector configured to detect a position of the grinding wheel; and a control device configured to, before processing using the grinding wheel is started, calculate a range in which the grinding wheel and the support are relatively moved on the basis of information on the positions of the workpiece and the grinding wheel detected by the first detector, the second detector, and the third detector, move the grinding wheel or the support by performing numerical control with respect to the feeding device, and automatically start the processing using the grinding wheel.

The present automatic grinding apparatus includes: a grinding wheel configured to grind a workpiece; a support configured to support the workpiece; a feeding device configured to change a relative position between the grinding wheel and the workpiece by moving the grinding wheel or the support; a first detector configured to detect a position of the workpiece in a cutting direction of the grinding wheel; a second detector configured to detect a position of the workpiece in a feeding direction vertical to the cutting direction; a third detector configured to detect a position of the grinding wheel; and a control device configured to, before processing using the grinding wheel is started, calculate a range in which the grinding wheel and the support are relatively moved on the basis of information on the positions of the workpiece and the grinding wheel detected by the first detector, the second detector, and the third detector, move the grinding wheel or the support by performing numerical control with respect to the feeding device, and automatically start the processing using the grinding wheel.

With this, an operator does not need to perform teaching operation for setting, for example, a range in which the grinding wheel and a workpiece are relatively moved. Thus, a burden on the operator is reduced, and, in addition, operation efficiency is improved. Further, because setting of a processing condition and grinding processing are automatically performed, it is possible to perform high-accuracy and high-quality grinding processing not depending on a level of skill of the operator.

Further, the present automatic grinding apparatus may include an operating device through which an instruction to automatically start the processing using the grinding wheel is input, the operating device being connected to the control device. With this, the operator can start grinding processing with simple operation, i.e., by inputting an instruction to start the processing with the use of the operating device.

Further, the present automatic grinding apparatus may further include: a first operating device through which an instruction to automatically start the processing using the grinding wheel and an instruction to restart the processing using the grinding wheel that is temporarily stopped are input, the first operating device being connected to the control device; a second operating device through which an instruction to temporarily stop the processing using the grinding wheel is input, the second operating device being connected to the control device; and a third operating device through which an instruction to completely stop the processing using the grinding wheel is input, the third operating device being connected to the control device.

With this, the operator can start grinding processing with simple operation, i.e., by inputting an instruction to start the processing with the use of the first operating device. Further, the operator can temporarily stop the grinding processing with simple operation using the second operating device and check a processing status or the like. Furthermore, thereafter, the operator can restart the grinding processing by operating the first operating device. Further, at the time of emergency or the like, the operator can immediately stop operation of the processing by inputting an instruction to completely stop the processing with the use of the third operating device. In addition, it is possible to reduce a possibility of erroneous operation in the above operation.

Further, the present automatic grinding apparatus may include no operation panel through which an instruction regarding processing is input to the control device. This makes it possible to remarkably reduce erroneous operation caused by, for example, the operator or the like unintentionally touching an operation button or the like.

Further, in the present automatic grinding apparatus, the control device may include a communication portion capable of transmitting/receiving processing information to/from an external device, and the control device may receive the processing information from a mobile information communication terminal that communicates with the control device via the communication portion. With this configuration, the operator can transmit processing information, such as a processing condition and/or an instruction to start or stop processing, to the control device by operating the mobile information communication terminal. The operator can operate the automatic grinding apparatus from a distant position.

Further, the control device may transmit the processing information to the mobile information communication terminal that communicates with the control device via the communication portion. With this, the operator can know processing information, such as a processing condition and/or a grinding state of a workpiece, via the mobile information communication terminal. As a result, the operator can check a status of the automatic grinding apparatus from a distant position. With this function, the operator can, for example, operate or monitor a plurality of automatic grinding apparatuses in parallel. With this, productivity of grinding processing is improved.

Hereinafter, an automatic grinding apparatus according to an embodiment of the present disclosure will be described in detail with reference to the drawings.

FIG. 1 is a perspective view illustrating an outline of an automatic grinding apparatus 1 according to an embodiment of the present disclosure. In the automatic grinding apparatus 1, a process until a grinding processing is started after a workpiece W is set is automated.

As illustrated in FIG. 1, the automatic grinding apparatus 1 includes a grinding wheel 10 for grinding a workpiece W and a table 12 serving as a support for supporting the workpiece W. The automatic grinding apparatus 1 grinds (polishes) an upper surface of the workpiece W by using the grinding wheel 10 so that the upper surface has a substantially planar shape.

The table 12 is configured to be reciprocatingly movable horizontally in a right and left direction (hereinafter, referred to as "X direction" as appropriate) seen from the front. The grinding wheel 10 is supported by a grinding wheel spindle head 15. The grinding wheel spindle head 15 is configured to be reciprocatingly movable in a vertical direction (hereinafter, referred to as "Y direction" as appropriate). Further, the grinding wheel spindle head 15 supporting the grinding wheel 10 is supported by a column 13. The column 13 is configured to be reciprocatingly movable horizontally in a forward and backward direction (hereinafter, referred to as "Z direction" as appropriate). In addition, the grinding wheel spindle head 15 supporting the grinding wheel 10 and the table 12 are reciprocatingly moved in the above respective directions with numerical control using a control device 30 (see FIG. 3) described below.

The grinding wheel 10 and the table 12 are arranged in a grinding processing region. The grinding processing region is covered by a housing 14. An opening is provided in a substantially central front surface and upper surface of the housing 14 in order that an operator performs setting of the workpiece W, removal of the workpiece W after processing, or the like. Openable doors 38 are provided in the opening.

A start button 42, a temporary stop button 46 serving as a second operating device, an emergency stop button 43 serving as a third operating device, and a display portion 41 are arranged on a front surface of the housing 14. The start button 42 is an operating device for allowing the operator to input an instruction to start grinding processing (processing using the grinding wheel 10). Furthermore, the start button 42 is a first operating device for allowing the operator to input an instruction to start grinding processing (processing using the grinding wheel 10) and an instruction to restart grinding processing that is temporarily stopped. When the operator executes simple operation, i.e., inputs an instruction to start the processing by pressing the start button 42, the automatic grinding apparatus 1 automatically detects the workpiece W set (placed) on the table 12 and automatically starts grinding processing of the workpiece W. Details thereof will be described below. Note that "grinding processing is automatically started" in this embodiment means that grinding processing is started without causing the operator to implement operation (teaching and the like) other than operation of pressing the start button 42.

The temporary stop button 46 is an operating device for allowing the operator to input an instruction to temporarily stop detection operation or grinding processing of the workpiece W. When the temporary stop button 46 is pressed by the operator, the automatic grinding apparatus 1 temporarily stops detection operation or grinding processing of the workpiece W. Specifically, when the temporary stop button 46 is pressed, movement of both or any one of the table 12 and the grinding wheel spindle head 15, which is performed by a table feeding device 34 (see FIG. 3), a grinding wheel forward/backward feeding device 35 (see FIG. 3), and a grinding wheel vertical feeding device 36 (see FIG. 3) described below, is temporarily stopped. With this, the operator can check a status or the like of grinding processing. Thereafter, when the operator presses the start button 42, movement of the table 12 and the grinding wheel spindle head 15, which is temporarily stopped, is restarted, and position detection operation or grinding processing is restarted.

The emergency stop button 43 is an operating device for allowing the operator to input an instruction to completely stop detection operation or grinding processing of the workpiece W at the time of emergency or the like. When the emergency stop button 43 is pressed by the operator, the automatic grinding apparatus 1 completely stops detection operation or grinding processing of the workpiece W. With this, the operator can immediately stop processing or the like using the automatic grinding apparatus 1 at the time of emergency or the like.

Note that the automatic grinding apparatus 1 does not include an operation panel for allowing the operator to input an instruction regarding processing. That is, on the main body 2 of the automatic grinding apparatus 1 or in the vicinity thereof, the start button 42, the temporary stop button 46, and the emergency stop button 43 are provided as constantly-connected operating devices. Meanwhile, an operation button for performing teaching operation, a manual pulse handle for adjusting a position of the table 12 or the like, which are provided in the automatic grinding apparatus of the related art, are not provided in the automatic grinding apparatus 1. With this, it is possible to remarkably reduce erroneous operation caused by, for example, the operator or the like unintentionally touching the operation button, the manual pulse handle, or the like.

The display portion 41 is, for example, a display. For example, a grinding amount of the workpiece W, setting of a finished surface, and/or an expected time taken to terminate grinding are displayed on the display portion 41. Further, for example, a detected shape of the workpiece W, a current position of the grinding wheel 10, and/or a process that is currently performed may be displayed on the display portion 41. With this, the operator can check a status or the like of grinding processing by using the display portion 41.

Further, for example, the display portion 41 may include a touchscreen. The start button 42 and the temporary stop button 46 serving as operating devices may be displayed on the display portion 41 as, for example, icons with which touch input can be performed. With this, the start button 42 and the temporary stop button 46 can be integrally provided with the display portion 41, and therefore it is possible to make those buttons compact.

Further, in a case where the display portion 41 is a touchscreen or the like, the display portion 41 may be configured so that set values and the like of a grinding amount of the workpiece W and a finished surface, which are displayed on the display portion 41, can be changed by the operator touching and operating a predetermined display region of the display portion 41. With this, the operator can set a basic processing condition or the like with simple operation.

A separate-type auxiliary operation terminal 51 for allowing the operator to perform various settings for grinding is removably connected to the main body 2 of the automatic grinding apparatus 1. The separate-type auxiliary operation terminal 51 is, for example, a mobile dedicated operating device or personal computer that can be carried by the operator. The operator can input various set values and the like regarding processing of the workpiece W to the automatic grinding apparatus 1 by operating the separate-type auxiliary operation terminal 51.

As described above, the separate-type auxiliary operation terminal 51 is removable from the automatic grinding apparatus 1. Specifically, the separate-type auxiliary operation terminal 51 is connected to the main body 2 of the automatic grinding apparatus 1 via a detachable connector or the like in a wired manner. Therefore, in a case where, for example, the operator inputs information such as a grinding processing condition, the operator may connect the separate-type auxiliary operation terminal 51 to the automatic grinding apparatus 1. In this case, the operator may remove the separate-type auxiliary operation terminal 51 from the main body 2 after completing advance preparations or the like for processing. Note that the automatic grinding apparatus 1 can cause the control device 30 to automatically execute grinding processing even in a state in which the separate-type auxiliary operation terminal 51 is removed and the automatic grinding apparatus 1 and the separate-type auxiliary operation terminal 51 do not communicate with each other.

Figure 2:
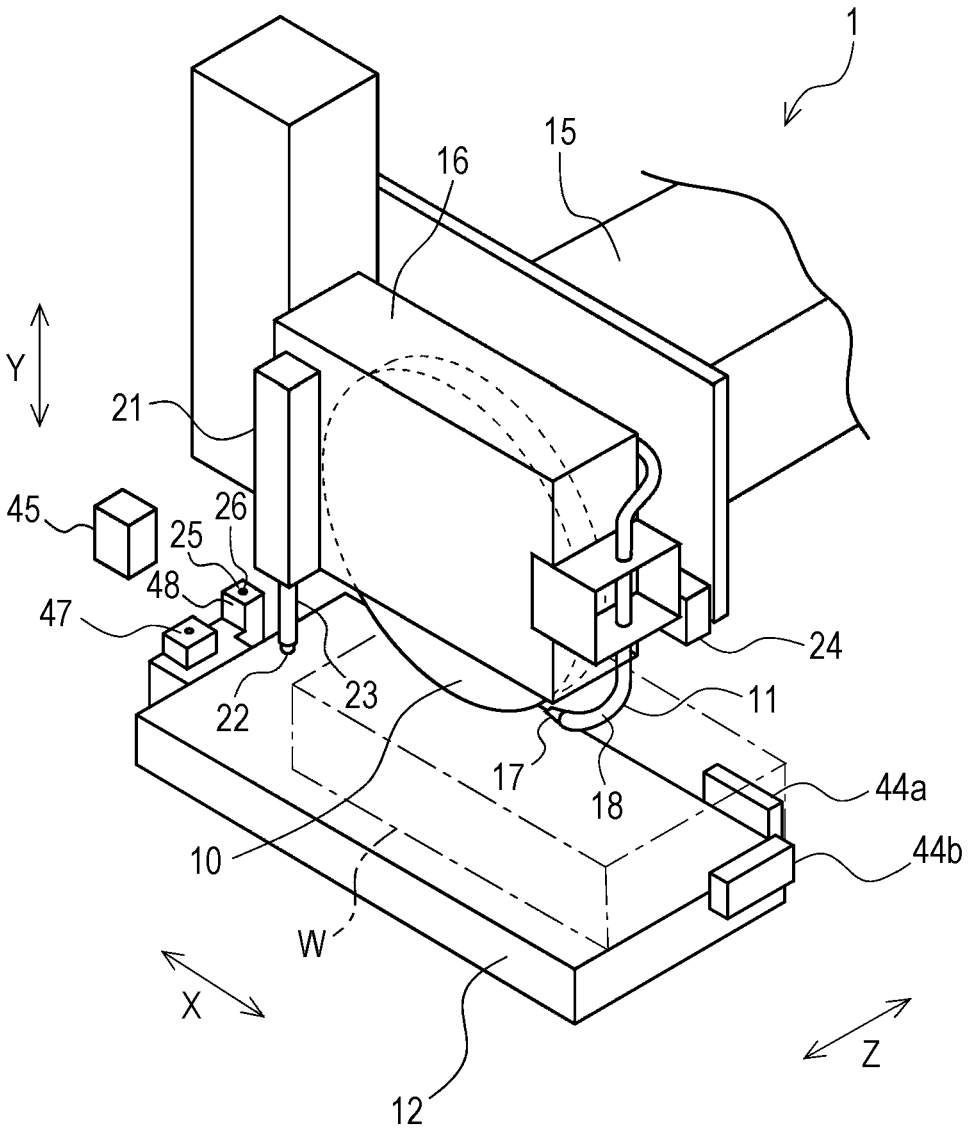
FIG. 2 is a perspective view illustrating a position in the vicinity of a grinding wheel and a table in an automatic grinding apparatus according to an embodiment of the present disclosure.

FIG. 2 is a perspective view illustrating a position in the vicinity of the grinding wheel 10 and the table 12 in the automatic grinding apparatus 1. As illustrated in FIG. 2, the automatic grinding apparatus 1 includes the grinding wheel spindle head 15. The grinding wheel spindle head 15 includes a grinding wheel spindle (not illustrated) extending in the Z direction. The grinding wheel 10 is provided in the vicinity of a tip of the grinding wheel spindle.

The grinding wheel 10 has a substantially disk shape. The grinding wheel 10 is brought into contact with the workpiece W while being rotated, thereby grinding the upper surface of the workpiece W. Further, the grinding wheel 10 is covered by a grinding wheel cover 16 whose lower part is open. As described above, the grinding wheel 10 is supported by the grinding wheel spindle head 15 that moves in the Y direction and the Z direction. Thus, the grinding wheel 10 relatively moves in conjunction with the grinding wheel spindle head 15 in the Y direction and the Z direction with respect to the table 12.

The table 12 serving as a support for placing (supporting) the workpiece W is provided below the grinding wheel 10. The table 12 is, for example, an electromagnetic chuck including an electromagnet. The table 12 can restrain the workpiece W from moving by supporting the placed workpiece W with the use of, for example, magnetic force.

Further, as described above, the table 12 is movable in the X direction serving as a feeding direction. With this, the table 12 can adjust a relative position between the grinding wheel 10 and the workpiece W in the X direction by moving the workpiece W. As described above, it is possible to change a relative position between the grinding wheel 10 and the workpiece W in the X direction, the Y direction, and the Z direction by moving the table 12 and the grinding wheel spindle head 15.

A workpiece thickness detection sensor 21 is provided to the grinding wheel spindle head 15 via the grinding wheel cover 16, a bracket (not illustrated), or the like. The workpiece thickness detection sensor 21 is a first detector for detecting a position of the workpiece W in a cutting direction of the grinding wheel 10, i.e., in the Y direction. Although details thereof will be described below, the workpiece thickness detection sensor 21 is a contact-type sensor and includes a probe 23 protruding in a downward direction and a contact 22 provided on a tip thereof.

As described above, the workpiece thickness detection sensor 21 is attached to the grinding wheel spindle head 15. Therefore, the workpiece thickness detection sensor 21 is moved with the grinding wheel spindle head 15 in the Y direction and the Z direction. Note that the workpiece thickness detection sensor 21 is desirably attached outside the grinding wheel cover 16 at a position slightly distant from the grinding wheel 10 in the X direction or the Z direction. With this, it is possible to restrain malfunction such as contact of the workpiece thickness detection sensor 21 to the workpiece W or the like at the time of grinding processing. Further, a position to which the workpiece thickness detection sensor 21 is attached may be a front surface of the grinding wheel cover 16 as illustrated in FIG. 2. Alternatively, the position to which the workpiece thickness detection sensor 21 is attached may be a side or the like of the grinding wheel cover 16.

A workpiece size detection sensor 24 is provided in the vicinity of the grinding wheel 10 of the grinding wheel spindle head 15 via a bracket (not illustrated) or the like. The workpiece size detection sensor 24 is a second detector for detecting a position (and/or size) of the workpiece W in the feeding direction, that is, the X direction and the Z direction vertical to the cutting direction of the grinding wheel 10, i.e., the Y direction. Although details thereof will be described below, the workpiece size detection sensor 24 is a non-contact-type sensor and, for example, detects presence/absence of the workpiece W by using a laser beam. The workpiece size detection sensor 24 is attached to the grinding wheel spindle head 15. Therefore, the workpiece size detection sensor 24 is moved with the grinding wheel spindle head 15 in the Y direction and the Z direction.

Further, an air injection nozzle 26, which is a detection portion of a grinding wheel diameter detection sensor 25, and a reference block 45 are provided on a side of the table 12. The grinding wheel diameter detection sensor 25 is a third detector and detects a position of the grinding wheel 10. Although details thereof will be described below, the grinding wheel diameter detection sensor 25 is, for example, a non-contact-type sensor such as an air sensor. The air injection nozzle 26 of the grinding wheel diameter detection sensor 25 is provided on an upper surface of a grinding wheel diameter detection block 48 arranged on the side of the table 12. The air injection nozzle 26 is moved with the table 12 in the X direction.

Note that, in this embodiment, the grinding wheel diameter detection sensor 25 is an example of the third detector for detecting a position of the grinding wheel 10. However, the third detector is not limited thereto. As the third detector, for example, a contact-type sensor such as the workpiece thickness detection sensor 21 may be used. Further, as the third detector, for example, an AE sensor (Acoustic Emission Sensor) including a piezoelectric element for detecting vibration may be employed. As the third detector, various other sensors can be employed.

The reference block 45 is a block serving as a reference used when a height or the like of the workpiece W is measured by the workpiece thickness detection sensor 21. The workpiece thickness detection sensor 21 detects a position of an upper surface of the reference block 45. Based on the position, the workpiece thickness detection sensor 21 obtains a position of the upper surface of the workpiece W and/or a position of an upper surface of the table 12.

Reference plates 44*a* and 44*b* are provided in the vicinity of a corner portion of the table 12, specifically, in the vicinity of a deeper corner portion on a side surface of the table 12, the side surface being an opposite surface of a side on which the reference block 45 is provided. The reference plates 44*a* and 44*b* serve as references when the workpiece W is placed on the table 12. The reference plate 44*a* serves as a reference position in the Z direction when the workpiece W is placed on the table 12. The reference plate 44*b* serves as a reference position in the X direction when the workpiece W is placed on the table 12. The operator sets (places) the workpiece W on the table 12 so that, in a case where the workpiece W is placed on the table 12, an end portion of the workpiece W is brought into contact with both the reference plates 44*a* and 44*b*. Because the reference plates 44*a* and 44*b* are provided as described above, the operator can easily set the workpiece W at a predetermined position of the table 12.

The automatic grinding apparatus 1 includes a grinding fluid supply device 11 for supplying a grinding fluid to the grinding wheel 10. The grinding fluid supply device 11 includes a tube 18 and a nozzle 17 for supplying a grinding fluid to a predetermined position of the grinding wheel 10, the predetermined position being in the vicinity of a part to be ground, a pump (not illustrated) for feeding a grinding fluid, and the like. A grinding fluid is supplied by the grinding fluid supply device 11 to a position in the vicinity of the part to be ground. With this, the grinding wheel 10 and the workpiece W are cooled, and therefore a favorable ground surface is obtained. Furthermore, grinding chips and the like are removed.

A dresser block 47 for dressing the grinding wheel 10 is provided in the vicinity of the table 12. The dresser block 47 includes, for example, a diamond dresser. With this, the grinding wheel 10 can be kept in a suitable state. As a result, it is possible to maintain accuracy and quality of grinding. Note that a device for dressing the grinding wheel 10 is not limited to a desktop device but also may be a numerical control type upper dresser device, a rotary dresser device, a swinging dresser device, or the like.

Figure 3:
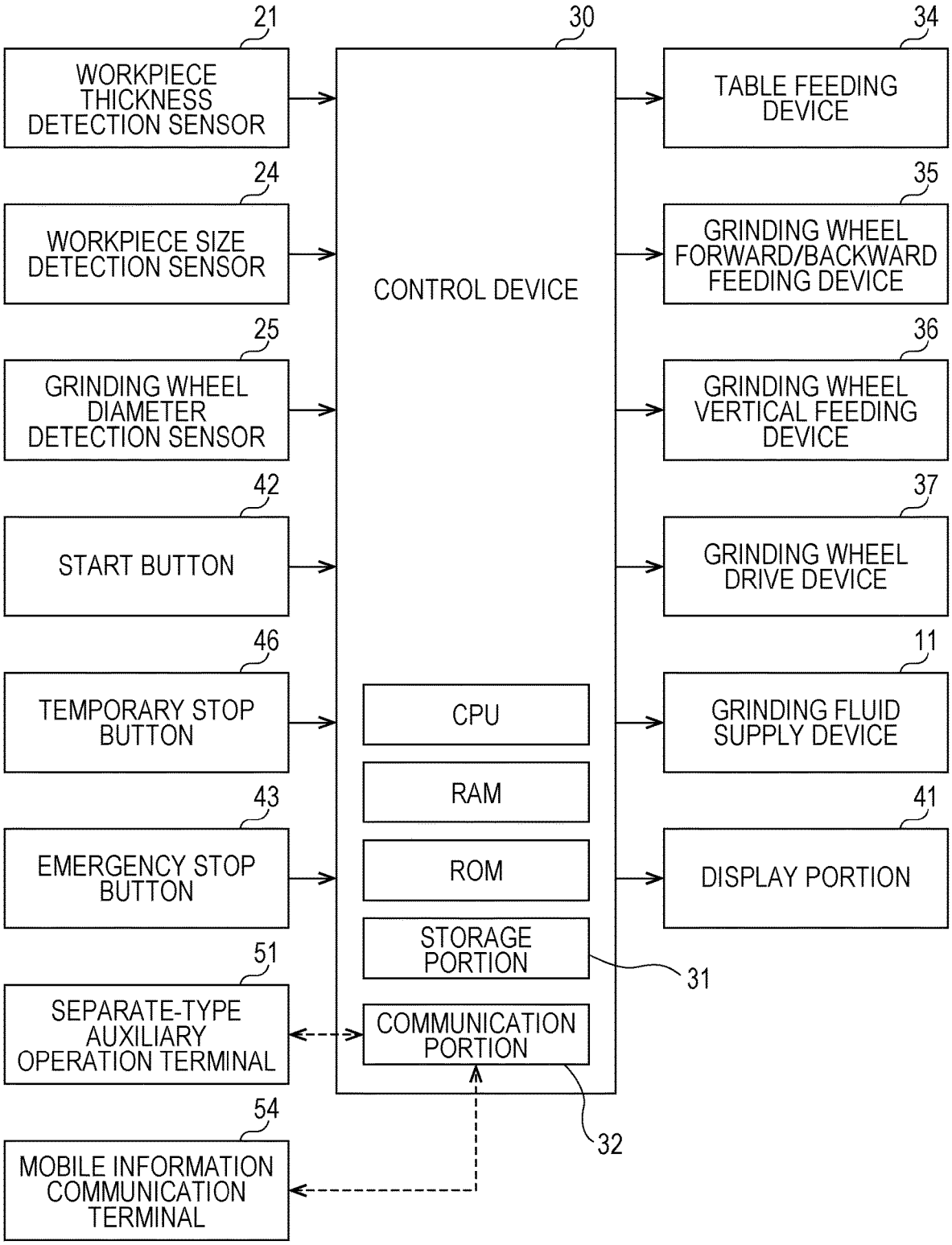
FIG. 3 is a control block diagram illustrating an outline of an automatic grinding apparatus according to an embodiment of the present disclosure.

FIG. 3 is a control block diagram illustrating an outline of the automatic grinding apparatus 1. As illustrated in FIG. 3, the automatic grinding apparatus 1 includes the control device 30 for performing numerical control of grinding processing. The control device 30 includes, for example, a CPU (Central Processing Unit), a ROM (Read Only Memory), a RAM (Random Access Memory), a storage portion 31 for storing a set value of a processing condition, a calculation result, and the like, and a communication portion 32 for communicating with the separate-type auxiliary operation terminal 51 or a mobile information communication terminal 54.

Note that the control device 30 may be provided inside the main body 2 (see FIG. 1) of the automatic grinding apparatus 1 or may be provided inside a housing or the like which is additionally provided to be adjacent to the main body 2.

As described above, the start button 42, the temporary stop button 46, and the emergency stop button 43 are operating devices for allowing the operator to input an instruction on operation and are connected to the control device 30 so that a signal can be transmitted to the control device 30. When the operator presses any one of the start button 42, the temporary stop button 46, and the emergency stop button 43, a signal is transmitted to the control device 30 from the pressed button. The control device 30 receives the signal and controls start or stop of grinding processing on the basis of this signal.

The workpiece thickness detection sensor 21, the workpiece size detection sensor 24, and the grinding wheel diameter detection sensor 25 are connected to the control device 30 so that a signal can be transmitted to the control device 30. A result detected by each sensor is transmitted to the control device 30. The control device 30 executes predetermined calculation on the basis of results detected by the workpiece thickness detection sensor 21, the workpiece size detection sensor 24, and the grinding wheel diameter detection sensor 25. With this, the control device 30 obtains various condition values and the like for grinding processing. Then, on the basis of a calculation result, the control device 30 controls the table feeding device 34, the grinding wheel forward/backward feeding device 35, the grinding wheel vertical feeding device 36, a grinding wheel drive device 37 described below, the grinding fluid supply device 11, and the like connected to the control device 30.

The table feeding device 34 is a device for moving the table 12 illustrated in FIG. 2 in the X direction by performing numerical control and includes, for example, a ball screw mechanism and a servomotor. The table feeding device 34 moves the table 12 by a predetermined amount by driving the servomotor and the like on the basis of a signal from the control device 30.

The grinding wheel forward/backward feeding device 35 is a device for moving the grinding wheel spindle head 15 illustrated in FIG. 2 in the Z direction by performing numerical control and includes, for example, a ball screw mechanism and a servomotor. The grinding wheel forward/backward feeding device 35 moves the grinding wheel spindle head 15 by a predetermined amount by driving the servomotor and the like on the basis of a signal from the control device 30.

The grinding wheel vertical feeding device 36 is a feeding device for moving the grinding wheel spindle head 15 in the Y direction and includes, for example, a ball screw mechanism and a servomotor. The grinding wheel vertical feeding device 36 moves the grinding wheel spindle head 15 by a predetermined amount by driving the servomotor and the like on the basis of a signal from the control device 30.

Note that driving methods of the table feeding device 34, the grinding wheel forward/backward feeding device 35, and the grinding wheel vertical feeding device 36 are not limited to the above examples. As the driving methods, other publicly-known methods such as a servo valve hydraulic cylinder and a linear motor can be employed.

The grinding wheel drive device 37 is a device for rotating the grinding wheel 10 and includes a motor and the like. The grinding wheel drive device 37 rotates the grinding wheel 10 at the predetermined number of rotations on the basis of a signal from the control device 30. Note that the control device 30 determines the number of rotations of the grinding wheel drive device 37 on the basis of information such as a finished surface input in advance.

Further, the display portion 41 is connected to the control device 30. The display portion 41 can display various types of information on grinding processing in accordance with control by the control device 30 as described above.

The communication portion 32 of the control device 30 has a function transmitting/receiving processing information and the like to/from an external device. The communication portion 32 includes, for example, a connector for connecting the separate-type auxiliary operation terminal 51 described above and a transmission/reception device for communicating with the mobile information communication terminal 54 in a wireless manner. The operator can transmit processing information of the workpiece W to be ground to the control device 30 by operating the separate-type auxiliary operation terminal 51. Examples of the processing information transmitted from the separate-type auxiliary operation terminal 51 encompass reference position information and correction values of the table feeding device 34, the grinding wheel forward/backward feeding device 35, and the grinding wheel vertical feeding device 36, a grinding amount of the workpiece W to be ground, and a processing condition such as a finished surface of grinding.

Note that examples of the processing condition encompass information indicating whether or not a shape of the workpiece W to be ground is a rectangular parallelepiped. With this, the control device 30 can know a shape of the workpiece W to be ground before measurement is performed by the workpiece size detection sensor 24, the workpiece thickness detection sensor 21, and the like. Therefore, the control device 30 can appropriately obtain moving ranges of the workpiece size detection sensor 24 and the workpiece thickness detection sensor 21 in accordance with the shape of the workpiece W. As a result, the control device 30 can efficiently measure the workpiece W.

The mobile information communication terminal 54 is, for example, a terminal having a wireless communication function, such as a smartphone. When the operator operates the mobile information communication terminal 54, processing information is transmitted to the control device 30 via the communication portion 32. The processing information transmitted via the mobile information communication terminal 54 may be, for example, information equal to information transmitted via the separate-type auxiliary operation terminal 51. Alternatively, the processing information transmitted via the mobile information communication terminal 54 may be, for example, an instruction to start grinding or stop grinding the workpiece W, such as instructions input via the start button 42, the temporary stop button 46, and the emergency stop button 43. That is, the mobile information communication terminal 54 also functions as an operating device. With this, the operator can operate the automatic grinding apparatus 1 also at a position distant from the automatic grinding apparatus 1 by operating the mobile information communication terminal 54.

Further, the mobile information communication terminal 54 can display (output) various types of processing information, such as a set value of a processing condition, a status of the workpiece W to be ground, and/or a state of progress of a processing process, to the operator by communicating with the control device 30 via the communication portion 32. With this, the operator can check a status of the automatic grinding apparatus 1 from a distant position via the mobile information communication terminal 54. Therefore, the operator can, for example, operate or monitor a plurality of automatic grinding apparatuses 1 in parallel. As a result, productivity of grinding processing is improved. Note that, as an output form of processing information to the operator, it is possible to employ various forms, such as display to a display of the mobile information communication terminal 54, audio output from a speaker, and vibration using a vibrator or the like. With this, it is possible to suitably communicate processing information to the operator.

Next, the workpiece thickness detection sensor 21, the workpiece size detection sensor 24, and the grinding wheel diameter detection sensor 25 will be described in detail with reference to FIG. 4 to FIG. 6.

Figure 4:
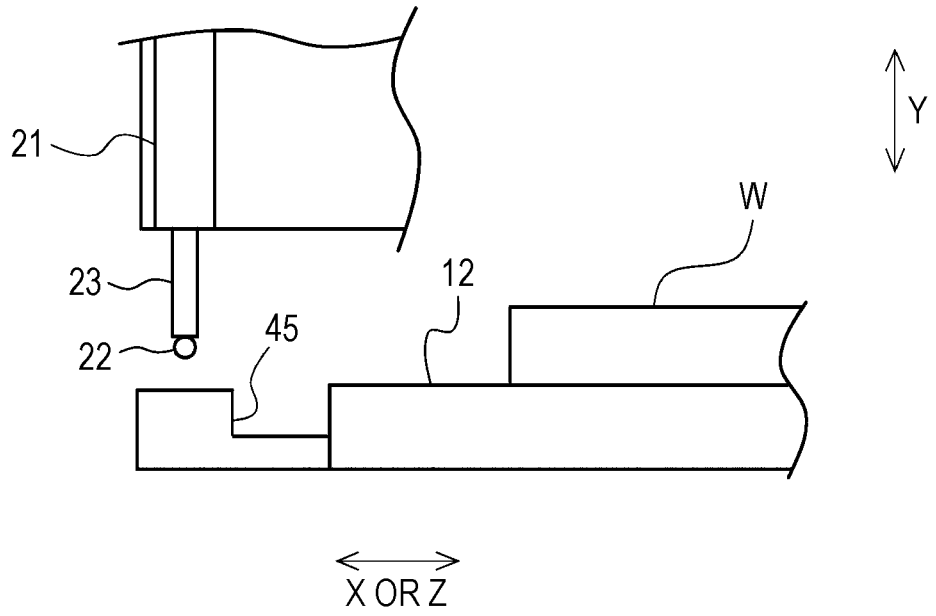
FIG. 4 illustrates detection using a workpiece thickness detection sensor of an automatic grinding apparatus according to an embodiment of the present disclosure.

FIG. 4 illustrates detection using the workpiece thickness detection sensor 21. As illustrated in FIG. 4, the workpiece thickness detection sensor 21 is a contact-type sensor and includes the probe 23 protruding in the downward direction. The substantially spherical contact 22 is provided to a lower end of the probe 23. The workpiece thickness detection sensor 21 (control device 30) brings the contact 22 into contact with the workpiece W or the table 12, thereby detecting a position thereof.

Specifically, the control device 30 (see FIG. 3) moves the workpiece thickness detection sensor 21 provided to the grinding wheel spindle head 15 (see FIG. 2) in the Y direction by controlling the grinding wheel vertical feeding device 36 (see FIG. 3). With this, the control device 30 brings the contact 22 into contact with the upper surface of the workpiece W or the table 12. Then, the control device 30 reads a coordinate value of the contact 22 in the Y direction (i.e., height of the workpiece W or the like) obtained when the contact 22 is brought into contact with the workpiece W or the like and stores the coordinate value. As described above, it is possible to obtain the height of the workpiece W with high accuracy by using a contact-type sensor as the workpiece thickness detection sensor 21.

Note that the contact 22 of the workpiece thickness detection sensor 21 is provided at a position lower than a position of a lower end of the grinding wheel 10 (see FIG. 2). With this, at the time of position detection using the workpiece thickness detection sensor 21, it is possible to restrain the grinding wheel 10 from being brought into contact with the table 12, the workpiece W, or the like.

Further, for example, in a case where a type of workpiece W to be ground is changed after the grinding wheel 10 is replaced and after the table 12 is washed, setup of the workpiece thickness detection sensor 21, such as setting of a reference point, is performed as an advance preparation before grinding processing is executed.

In the setup of the workpiece thickness detection sensor 21, the control device 30 causes the contact 22 of the workpiece thickness detection sensor 21 to abut the upper surface of the reference block 45. With this, a Y-direction coordinate value (i.e., height) of the upper surface of the reference block 45, which serves as a reference point, is obtained. Then, the control device 30 moves the table 12 in the X direction, thereby causing the contact 22 of the workpiece thickness detection sensor 21 to abut the upper surface of the table 12. With this, the Y-direction coordinate value of the upper surface of the table 12 is detected. With this, a height of the upper surface of the table 12 based on the upper surface of the reference block 45 is obtained.

Figure 5:
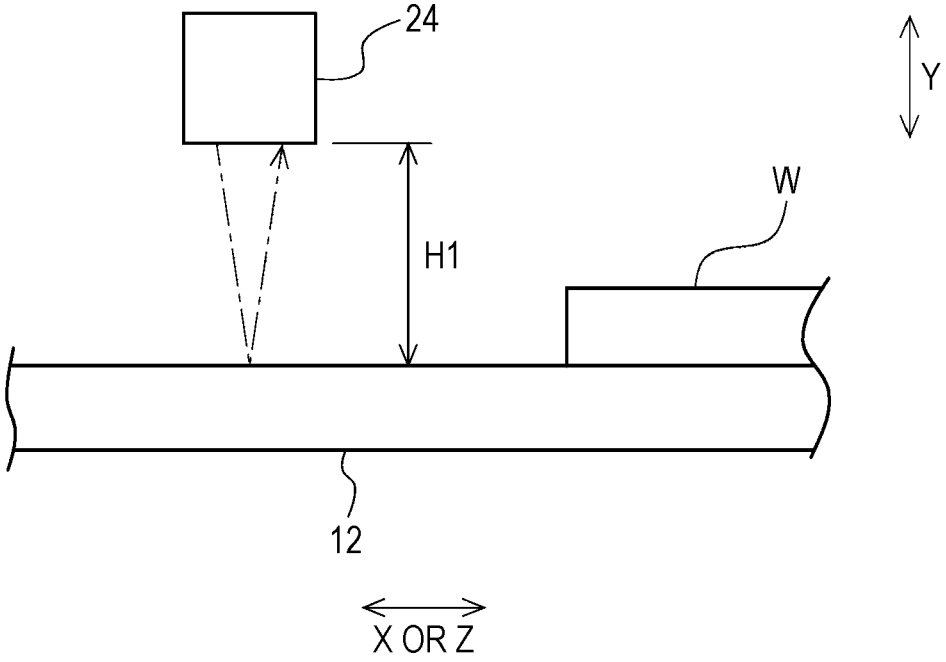
FIG. 5 illustrates detection using a workpiece size detection sensor of an automatic grinding apparatus according to an embodiment of the present disclosure.

FIG. 5 illustrates detection using the workpiece size detection sensor 24. Note that an alternate long and short dash line shown in FIG. 5 indicates a laser beam emitted from the workpiece size detection sensor 24.

As illustrated in FIG. 5, the workpiece size detection sensor 24 is a non-contact-type sensor using a laser beam. The workpiece size detection sensor 24 includes a light demitting element for emitting a laser beam and a light receiving element for detecting a laser beam. In the workpiece size detection sensor 24, a laser beam is emitted from the light emitting element in the downward direction, and the laser beam reflected from the workpiece W or the table 12 is detected by the light receiving element. With this, the workpiece size detection sensor 24 (control device 30) detects whether or not the workpiece W exists in an emission range. The control device 30 (see FIG. 3) can also detect presence/absence of the workpiece W while changing a relative position between the workpiece W and the workpiece size detection sensor 24 in the feeding direction by moving the table 12 in the X direction and moving the column 13 (see FIG. 1) in the Z direction. With this, the control device 30 can obtain the size of the workpiece W in the X direction and the Z direction.

Note that setup of the workpiece size detection sensor 24 is performed as an advance preparation of grinding processing. In the setup of the workpiece size detection sensor 24, the control device 30 adjusts a position of the workpiece size detection sensor 24 so that a height from the table 12 to the workpiece size detection sensor 24 becomes a desired reference value (reference height; height H1) that matches a detection range of the workpiece size detection sensor 24. Then, the control device 30 executes, for example, zero-setting tuning of the workpiece size detection sensor 24 by emitting a laser beam from a lower part of the workpiece size detection sensor 24 positioning at the reference height H1.

Figure 6:
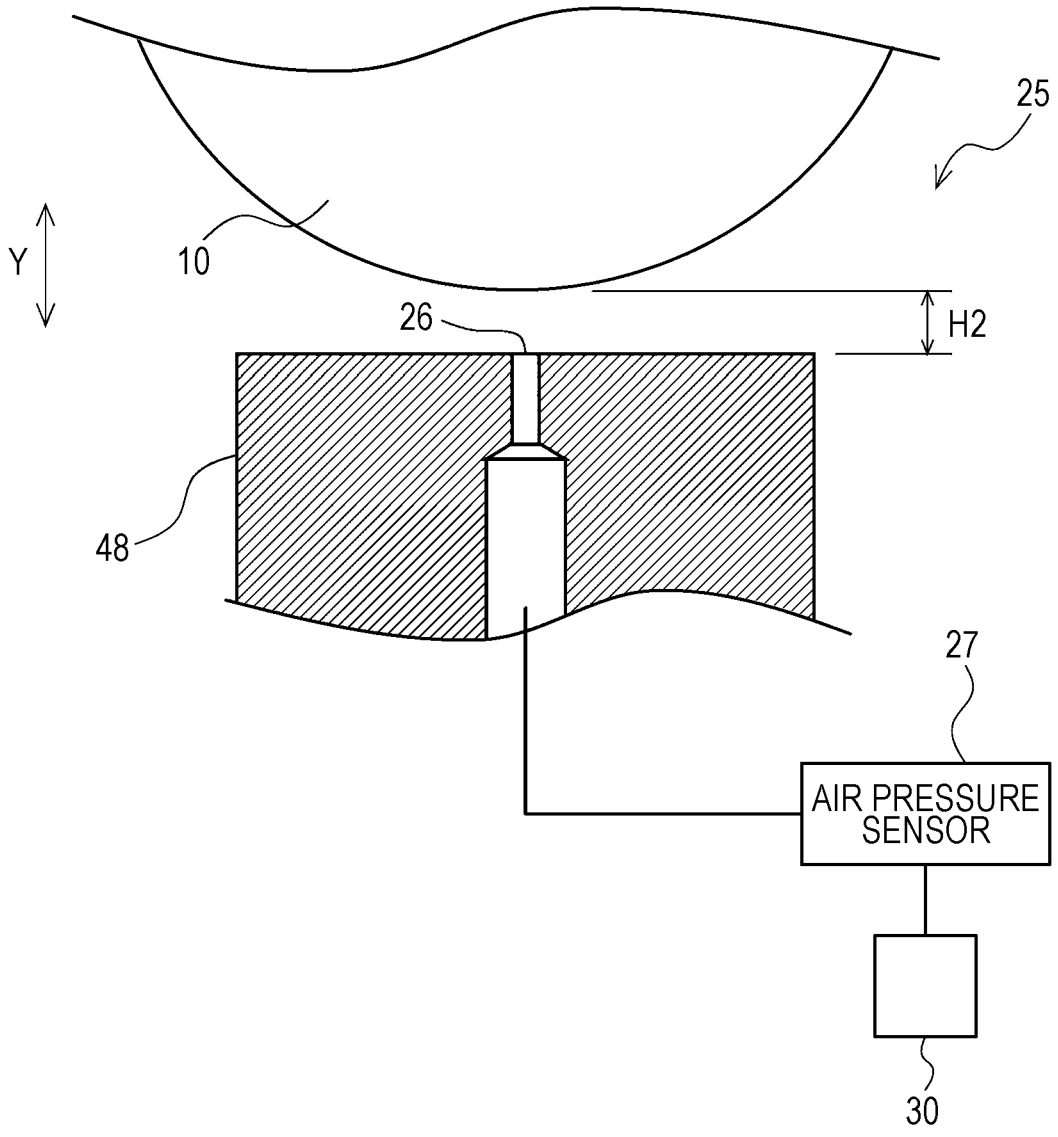
FIG. 6 illustrates detection using a grinding wheel diameter detection sensor of an automatic grinding apparatus according to an embodiment of the present disclosure.

FIG. 6 illustrates detection using the grinding wheel diameter detection sensor 25. As illustrated in FIG. 6, the grinding wheel diameter detection sensor 25 is, for example, a non-contact-type air sensor. The grinding wheel diameter detection sensor 25 includes the air injection nozzle 26 serving as a detection portion and an air pressure sensor 27. The air pressure sensor 27 supplies air to the air injection nozzle 26 and detects pressure of air. The air injection nozzle 26 is a detection portion of the grinding wheel diameter detection sensor 25 as described above and is provided in the grinding wheel diameter detection block 48. The air pressure sensor 27 is connected to the air injection nozzle 26 via a tube or the like.

The grinding wheel diameter detection sensor 25 detects a position of the grinding wheel 10. At this time, the control device 30 (see FIG. 3) relatively moves the grinding wheel 10 in an XZ plane so that the grinding wheel 10 positions above the air injection nozzle 26 of the grinding wheel diameter detection sensor 25. Then, the control device 30 arranges the grinding wheel 10 in a comparatively high location by controlling the grinding wheel vertical feeding device 36. Furthermore, the control device 30 blows air through the air injection nozzle 26 of the grinding wheel diameter detection sensor 25 toward the grinding wheel 10 while lowering the grinding wheel 10 by controlling the grinding wheel vertical feeding device 36.

The air pressure sensor 27 detects back pressure of the air injection nozzle 26. The back pressure of the air injection nozzle 26 is changed depending on a height of the grinding wheel 10. The height of the grinding wheel 10 is a length from an upper end of the air injection nozzle 26 to a lower end portion of an outer circumference of the grinding wheel 10. Back pressure, which is detected by the air pressure sensor 27 when the height of the grinding wheel 10 becomes a reference height H2, is set back pressure. The control device 30 reads a Y-direction coordinate value of a position of the grinding wheel 10 obtained when the set back pressure is detected and stores the coordinate value.

Based on the position of the grinding wheel 10 detected as described above, feeding in the cutting direction (i.e., Y direction) of the grinding wheel 10 (grinding range in the Y direction) at the time of grounding the workpiece W is subjected to numerical control. With this, it is possible to cause the outer circumference of the grinding wheel 10 to accurately abut the workpiece W.

Note that setup of the grinding wheel diameter detection sensor 25 is performed as an advance preparation of grinding processing. That is, back pressure obtained when the height of the grinding wheel 10 is the above reference height H2 is set (measured) in advance. Further, in the setup of the grinding wheel diameter detection sensor 25, calibration and the like of the grinding wheel diameter detection sensor 25 may be performed on the basis of the above reference height H2. Further, in the setup of the grinding wheel diameter detection sensor 25, for example, a difference between a Y-direction coordinate value of the lower end portion of the outer circumference of the grinding wheel 10, which is obtained in a case where the grinding wheel 10 is positioned at the reference height H2, and a Y-direction coordinate value of the diamond dresser of the dresser block 47 (see FIG. 2) may be set and input.

Herein, a central position of the grinding wheel 10 is grasped with numerical control performed by the control device 30. With this, the control device 30 can obtain a distance from the central position of the grinding wheel 10 to the outer circumference of the grinding wheel 10 (i.e., radius of the grinding wheel 10). With this, the control device 30 can detect an abrasion state of the grinding wheel 10 by using the grinding wheel diameter detection sensor 25. Therefore, the operator or the control device 30 can determine whether or not dressing, replacement, or the like of the grinding wheel 10 is necessary.

Further, the grinding wheel diameter detection sensor 25 is a non-contact-type sensor as described above. Therefore, the control device 30 can detect the position of the grinding wheel 10 while rotating the grinding wheel 10. That is, in a case where the grinding wheel diameter detection sensor 25 is a contact-type sensor, the control device 30 stops the grinding wheel 10, then detects the position of the grinding wheel 10, starts rotation of the grinding wheel 10 again after detection, and sets the number of rotations thereof as a predetermined number of rotations. The non-contact-type grinding wheel diameter detection sensor 25 does not need to stop rotation of the grinding wheel 10. Thus, it is possible to reduce time taken to detect the position of the grinding wheel 10, and therefore productivity is improved.

The setup of the workpiece thickness detection sensor 21, the setup of the workpiece size detection sensor 24, the setup of the grinding wheel diameter detection sensor 25, other advance preparations, and the like described above may be performed in such a manner that the operator connects the separate-type auxiliary operation terminal 51 illustrated in FIG. 1 to the automatic grinding apparatus 1. That is, the operator inputs various types of processing information by operating the separate-type auxiliary operation terminal 51. This processing information includes, for example, reference position information and/or correction values of the table feeding device 34, the grinding wheel forward/backward feeding device 35, and the grinding wheel vertical feeding device 36 and processing conditions such as a grinding amount of the workpiece W and/or a finished surface of grinding. Note that various set values input, detected, and calculated in the advance preparations are recorded on the storage portion 31 (see FIG. 3) of the control device 30 and are used for numerical control at the time of grinding processing.

Note that the advance preparations such as each setup described above may be executed as necessary. It is not necessary to execute the advance preparations every time when normal grinding processing is performed. As described above, the automatic grinding apparatus 1 automatically detects the workpiece W set on the table 12 and automatically starts grinding processing with respect to the workpiece W by executing simple operation of pressing the start button 42, without causing the operator to perform complicated operation.

Hereinafter, normal grinding operation in which grinding processing is automatically executed after advance preparations are performed will be described in detail with reference to FIG. 7 to FIG. 10.

Figure 7:
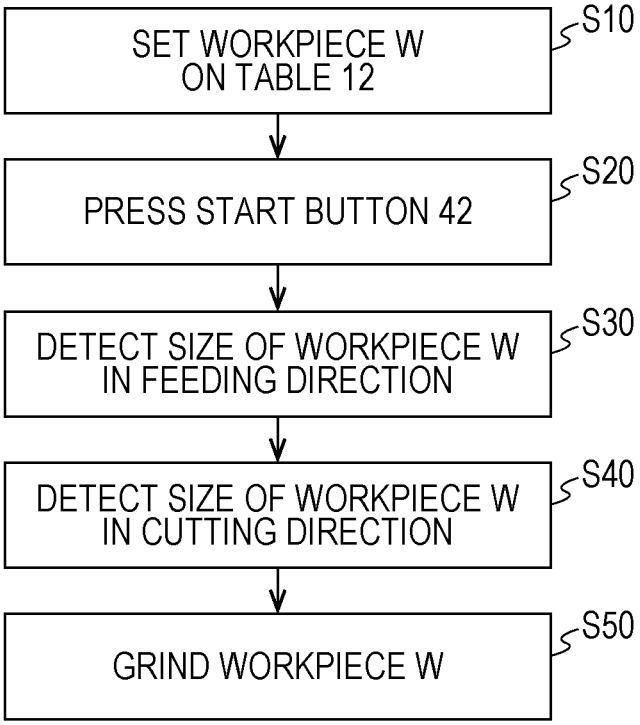
FIG. 7 is a flowchart showing control operation until grinding is started in an automatic grinding apparatus according to an embodiment of the present disclosure.
Figure 8:
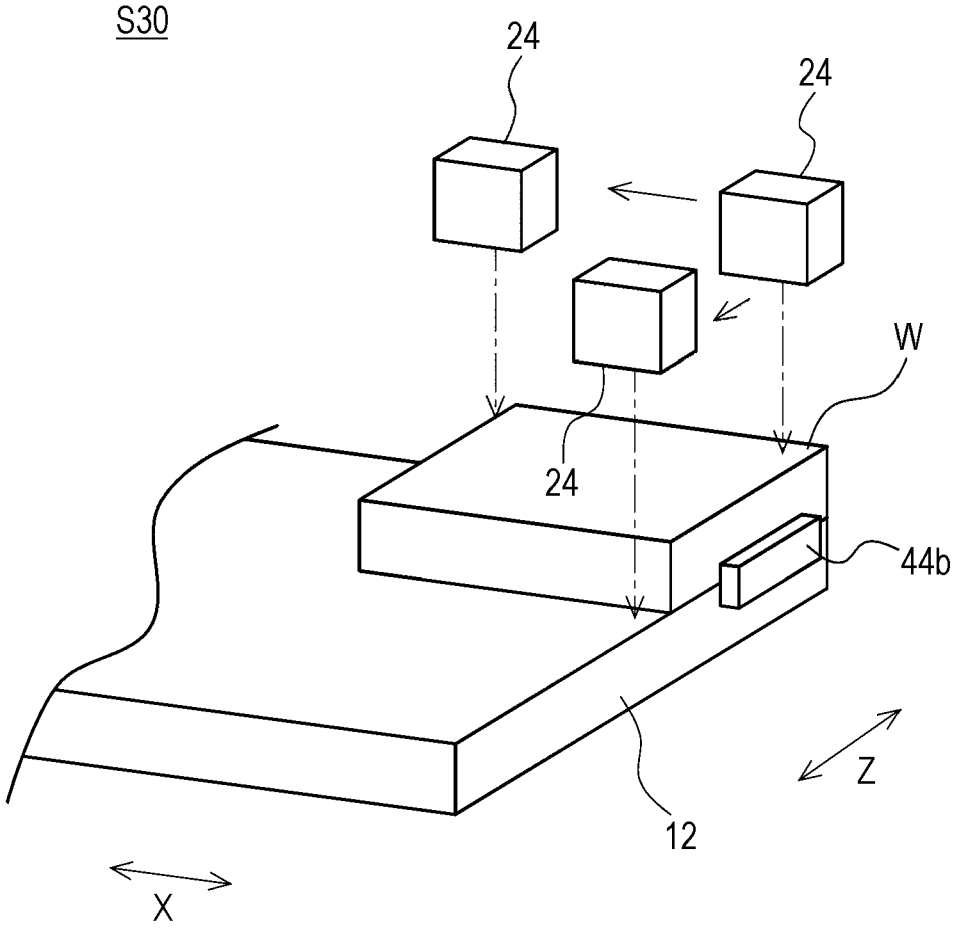
FIG. 8 is a perspective view illustrating operation for detecting a size of a workpiece in a feeding direction in an automatic grinding apparatus according to an embodiment of the present disclosure.
Figure 9A:
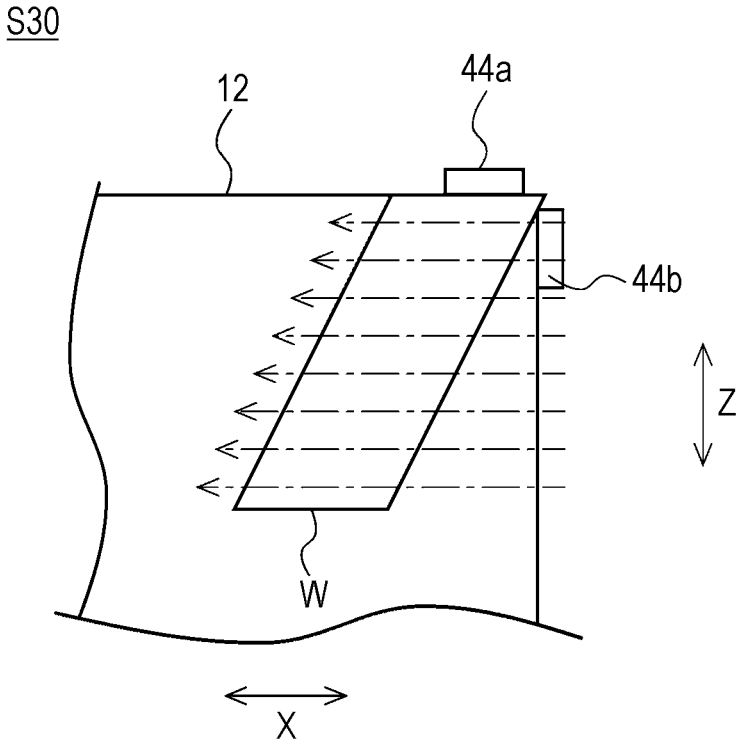
FIG. 9A is a plan view illustrating operation for detecting a size of a workpiece in an X direction in an automatic grinding apparatus according to an embodiment of the present disclosure.
Figure 9B:
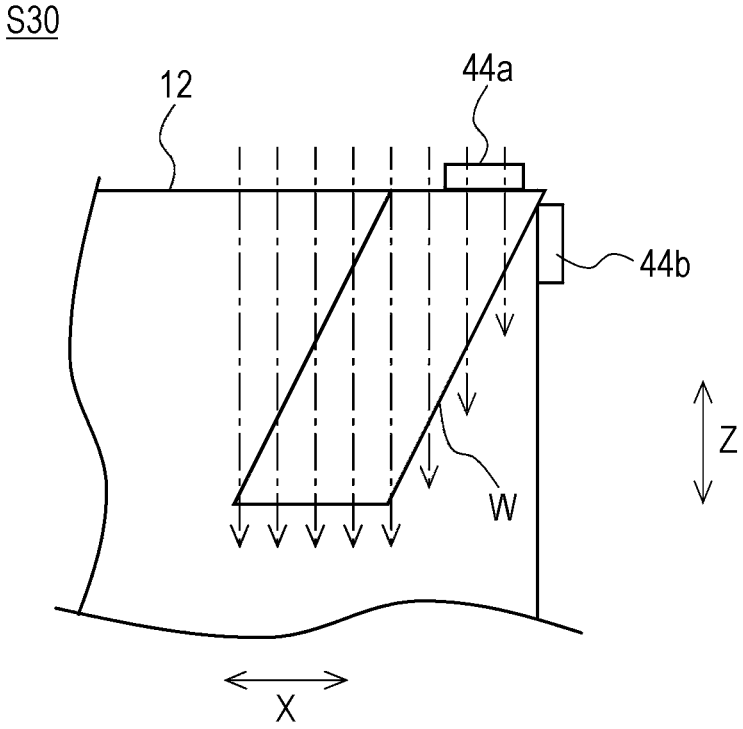
FIG. 9B is a plan view illustrating operation for detecting a size of a workpiece in a Z direction in an automatic grinding apparatus according to an embodiment of the present disclosure.
Figure 10A:
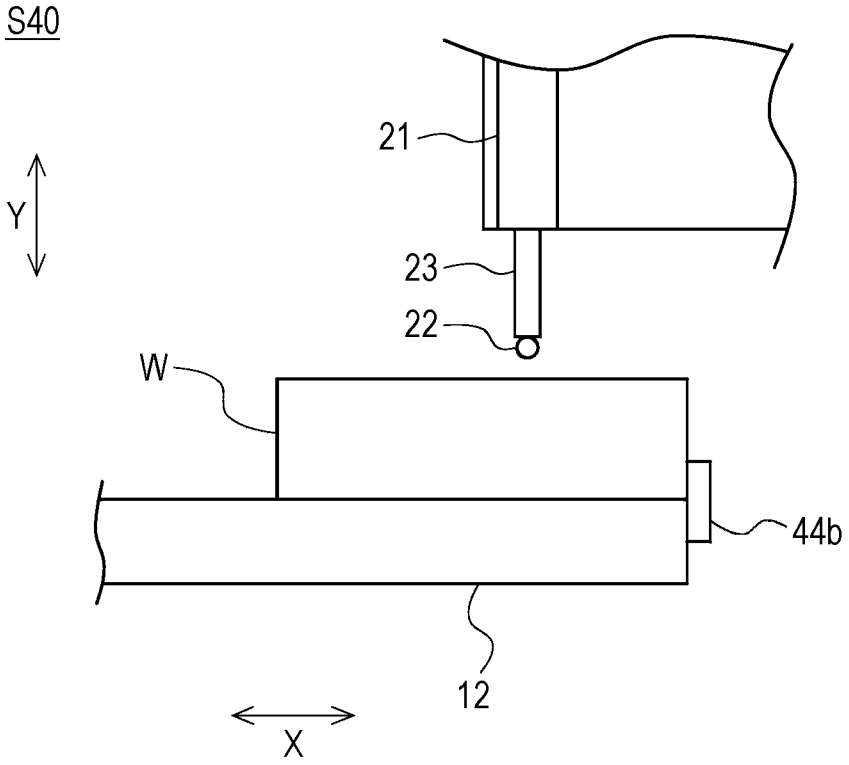
FIG. 10A is a front view illustrating operation for detecting a size (thickness) of a workpiece in a cutting direction in an automatic grinding apparatus according to an embodiment of the present disclosure.
Figure 10B:
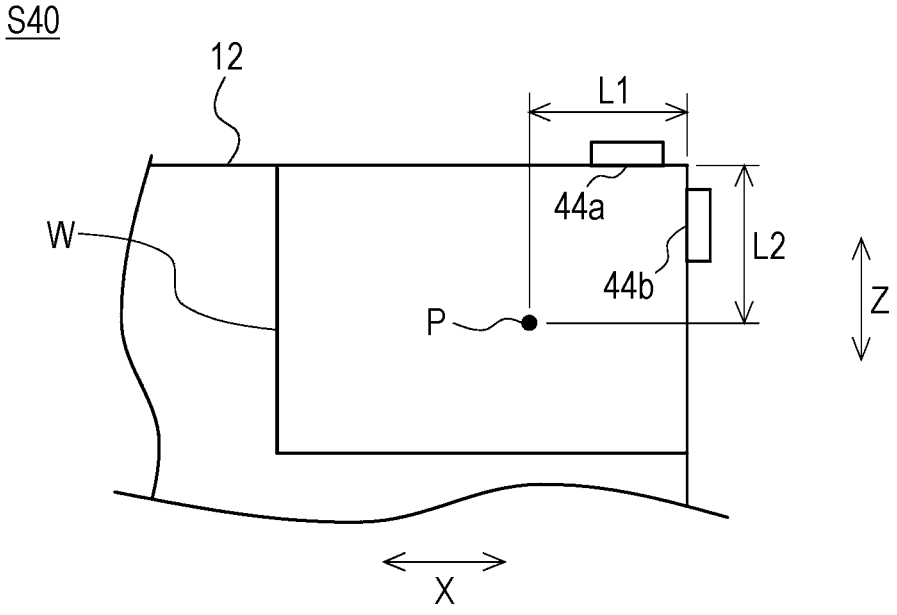
FIG. 10B is a plan view illustrating operation for detecting a size (thickness) of a workpiece in a cutting direction in an automatic grinding apparatus according to an embodiment of the present disclosure.

FIG. 7 is a flowchart showing control operation until grinding is started in the automatic grinding apparatus 1. FIG. 8 is a perspective view illustrating operation for detecting the size of the workpiece W in the feeding direction in the automatic grinding apparatus 1. FIG. 9A is a plan view illustrating operation for detecting the size of the workpiece W in the X direction in the automatic grinding apparatus 1. FIG. 9B is a plan view illustrating operation for detecting the size of the workpiece W in the Z direction in the automatic grinding apparatus 1. FIG. 10A is a front view illustrating operation for detecting the size (thickness) of the workpiece in the cutting direction in the automatic grinding apparatus. FIG. 10B is a plan view illustrating operation for detecting the size (thickness) of the workpiece in the cutting direction in the automatic grinding apparatus.

Note that alternate long and short dash lines shown in FIG. 8 indicate laser beams emitted from the workpiece size detection sensor 24. Alternate long and short dash lines shown in FIG. 9 indicate positions through which laser beams emitted from the workpiece size detection sensor 24 pass.

As illustrated in FIG. 7, first, an operator places a workpiece W to be ground on a predetermined position of the table 12 (Step S10). At that time, the workpiece W may be arranged so that an end portion thereof abuts the reference plate 44*a* and the reference plate 44*b* illustrated in FIG. 2.

Then, after the workpiece W is set on the table 12, the operator presses the start button 42 (Step S20). With this, an operation signal to instruct that processing be started is transmitted to the control device 30 (see FIG. 3), and operation of the automatic grinding apparatus 1 is started.

When the start button 42 is pressed by the operator, the automatic grinding apparatus 1 (control device 30) measures a size of the workpiece W in a horizontal direction by using the workpiece size detection sensor 24 (see FIG. 8) (Step S30). As illustrated in FIG. 8, the control device 30 relatively moves the workpiece size detection sensor 24 in the X direction or the Z direction by using a position in the vicinity of the reference plate 44*a* (see FIG. 9) and the reference plate 44*b* as a reference of start of measurement. With this, the control device 30 detects presence/absence and the size of the workpiece W. Note that a Y-direction position of the workpiece size detection sensor 24 is a position corresponding to a reference height from the table 12 (height H1 shown in FIG. 5) set in advance.

Specifically, the control device 30 changes a relative position between the workpiece W and the workpiece size detection sensor 24 by moving the table 12 in the X direction on a predetermined Z-direction coordinate while emitting a laser beam from the workpiece size detection sensor 24. Then, the control device 30 records a coordinate value of a position of the workpiece size detection sensor 24 obtained when the workpiece W is detected and a coordinate value of a position of the workpiece size detection sensor 24 obtained when the workpiece W is no longer detected. With this, there is detected a position and size of the workpiece W in the X direction at a Z-direction position at which the workpiece size detection sensor 24 is relatively moved. Also in the Z direction, similar detection operation is performed by moving the column 13 (see FIG. 1) in the Z direction.

Note that, in the advance preparations, a shape of the workpiece W is set to be a rectangular parallelepiped in some cases. In this case, it is possible to grasp the position and size of the workpiece W by performing detection operation once in the X direction and once in the Z direction. Thus, it is unnecessary to reciprocatingly move the table 12 in the X direction a plurality of times and the column 13 in the Z direction a plurality of times. As a result, it is possible to reduce time taken to perform measurement.

Further, as described above, in a case where the shape of the workpiece W is set to be a rectangular parallelepiped and a side surface of the workpiece W is arranged to abut the reference plate 44*a* and the reference plate 44*b* set as the reference positions in advance, it is also possible to omit detection of a position of the workpiece W on the reference-plate-44*a* side and reference-plate-44*b* side. With this, it is possible to reduce moving distances of the table 12 and the column 13, and therefore position detection can be made more efficient.

As illustrated in FIG. 9A, in a case where the shape of the workpiece W is a shape other than a rectangular parallelepiped, detection operation may be performed a plurality of times in the X direction and a plurality of times in the Z direction. Specifically, the control device 30 changes a relative position between the workpiece W and the workpiece size detection sensor 24 in the X direction by moving the table 12 in the X direction on a predetermined Z-direction coordinate while emitting a laser beam from the workpiece size detection sensor 24 (see FIG. 8).

Then, the control device 30 records a coordinate value of a position of the workpiece size detection sensor 24 obtained when the workpiece W is detected and a coordinate value of a position of the workpiece size detection sensor 24 obtained when the workpiece W is no longer detected. With this, there is detected a position and size of the workpiece W in the X direction at a Z-direction position in which the workpiece size detection sensor 24 is relatively moved.

Then, the control device 30 repeats detection operation that is performed while the table 12 is being moved in the X direction a plurality of times, the detection operation being similar to the above detection operation, while changing a Z-direction coordinate of the workpiece size detection sensor 24 by moving the column 13 (see FIG. 1) in the Z direction. With this, it is possible to detect positions and shapes of both end portions of the workpiece W in the X direction.

Then, as also in the Z direction, the control device 30 reciprocatingly moves the column 13 in the Z direction a plurality of times while changing an X-direction coordinate by moving the table 12 in the X direction. With this, the control device 30 executes detection operation a plurality of times while changing a relative position between the workpiece W and the workpiece size detection sensor 24 in the Z direction. With this, positions and shapes of both end portions of the workpiece W in the Z direction are detected. In this way, the position and shape of the workpiece W are detected.

Then, the control device 30 calculates a grinding range in the feeding direction on the basis of position information of the workpiece W detected by the workpiece size detection sensor 24. That is, the control device 30 calculates and sets a range in which the workpiece W is reciprocatingly moved in grinding processing. Specifically, the control device 30 calculates and sets a position at which movement of the table 12 is reversed in the X direction, a position at which movement of the column 13 is reversed in the Z direction, and the like. With this, the shape of the workpiece W is accurately detected by automatic control performed by the control device 30, without causing the operator to perform teaching operation and the like. Furthermore, the grinding range in the feeding direction (X direction and Z direction) is suitably set in accordance with the detected shape of the workpiece W.

Then, as illustrated in FIG. 7, after the size of the workpiece W in the feeding direction is detected (Step S30), the control device 30 measures a height (thickness) of the workpiece W by using the workpiece thickness detection sensor 21 (see FIG. 10) (Step S40). As illustrated in FIG. 10A, the control device 30 brings the contact 22 of the workpiece thickness detection sensor 21 into contact with a predetermined position on an upper surface of the workpiece W by relatively moving the workpiece thickness detection sensor 21 to a predetermined position. Then, the control device 30 records a coordinate of a position of the contact 22 obtained when the contact 22 is brought into contact with the upper surface of the workpiece W.

Note that the above detection using workpiece thickness detection sensor 21 is performed on the basis of a position of the upper surface of the reference block 45 (see FIG. 4) described above. That is, the control device 30 obtains a height from the upper surface of the reference block 45 to the upper surface of the workpiece W and a height from the upper surface of the reference block 45 to the upper surface of the table 12. The control device 30 obtains a thickness (height) of the workpiece W by obtaining a difference between those heights. With this, it is possible to accurately measure the thickness of the workpiece W at a predetermined position. As a result, it is possible to cause the height of the grinding wheel 10 (see FIG. 2) to match the workpiece W.

As illustrated in FIG. 10B, the above predetermined position at which the thickness of the workpiece W is measured by the workpiece thickness detection sensor 21 may be, for example, a position P that is distant in the X direction by a distance L1 and distant in the Z direction by the distance L2 on the basis of the corner portion of the table 12 in the vicinity of the reference plates 44*a* and 44*b*. The distance L1 and the distance L2 may have values set in advance by performing advance preparations.

Further, the distance L1 and the distance L2 may be calculated and set by the control device 30 on the basis of a position of the detected workpiece W in the feeding direction. With this, for example, it is possible to restrain a part in which the workpiece W does not exist from being measured. Further, the position P at which the thickness of the workpiece W is measured is not limited to one part. For example, the thickness of the workpiece W may be detected at a plurality of positions in accordance with the size of the workpiece W. In that case, the control device 30 may set a plurality of positions P at which the thickness is measured by performing calculation on the basis of position information of the workpiece W detected by the workpiece size detection sensor 24.

Then, the control device 30 sets a feeding speed of the grinding wheel 10 in the cutting direction, the number of rotations of the grinding wheel 10, and/or the like by performing calculation on the basis of, for example, position information of the workpiece W detected by the workpiece size detection sensor 24, information on the thickness of the workpiece W detected by the workpiece thickness detection sensor 21, position information of the grinding wheel 10 detected by the grinding wheel diameter detection sensor 25 (see FIG. 6), and information such as a grinding amount and/or a finished surface of the workpiece W set in an advance preparation. Furthermore, before processing using the grinding wheel 10 is started, the control device 30 calculates a range (grinding range regarding the X direction, the Y direction, and the Z direction) in which the grinding wheel 10 and the table 12 are relatively moved on the basis of the information on the positions of the workpiece W and the grinding wheel 10 detected by the workpiece thickness detection sensor 21, the workpiece size detection sensor 24, and the grinding wheel diameter detection sensor 25.

Then, as illustrated in FIG. 7, after detection of the workpiece W is completed, the automatic grinding apparatus 1 (control device 30) starts grinding the workpiece W within the grinding range set by the control device 30 (see FIG. 3) on the basis of a detection result (Step S50). That is, the control device 30 moves the grinding wheel 10 or the table 12 by performing numerical control with respect to the table feeding device 34, the grinding wheel forward/backward feeding device 35, and the grinding wheel vertical feeding device 36, and automatically starts processing using the grinding wheel 10.

Then, after grinding is terminated, the operator performs operation such as extraction of the workpiece W from the automatic grinding apparatus 1.

As described above, when the operator executes simple operation of setting the workpiece W and then pressing the start button 42 to input an instruction to start processing, the automatic grinding apparatus 1 (control device 30) automatically detects the workpiece W set on the table 12 and automatically starts grinding processing.

By using the automatic grinding apparatus 1, the operator does not need to perform teaching operation for setting, for example, a range in which the grinding wheel 10 and the workpiece W are relatively moved. Thus, a burden on the operator is reduced and operation efficiency is improved. Further, the automatic grinding apparatus 1 automatically performs setting of a processing condition and grinding processing. Therefore, it is possible to perform high-accuracy and high-quality grinding processing not depending on a level of skill of the operator.

Note that, in control operation until grinding is started in the above embodiment, the size of the workpiece W in the feeding direction is detected in Step S30, and thereafter the height of the workpiece W is detected in Step S40. Instead of this, order of those control steps may be reversed. That is, the control device 30 may detect the height of the workpiece W and thereafter detect the size of the workpiece W in the feeding direction.

In the above description, as an example of an embodiment of the present disclosure, the automatic grinding apparatus 1 that does not include an operation panel for allowing an operator to input an instruction regarding processing has been described. However, the automatic grinding apparatus 1 may include an operation panel in the main body 2 or in the vicinity thereof as an operating device constantly connected to the control device 30. This operation panel includes, for example, operation buttons for allowing the operator to input various instructions and a display device for displaying processing information. Further, the automatic grinding apparatus 1 may include, for example, a manual pulse handle for allowing the operator to adjust a position of the table 12 or the like.

With this, the operator can perform not only operation in which grinding processing is automatically started with simple operation of setting the workpiece W and pressing the start button 42 as described above but also teaching operation and setting of other detailed processing conditions by manual operation as necessary.

Note that, in a case where the automatic grinding apparatus 1 includes the operation panel as described above, the start button 42, the temporary stop button 46, the emergency stop button 43, and the display portion 41 may be provided on the operation panel. Further, the start button 42, the temporary stop button 46, and the display portion 41 may be displayed on a part of another display provided on the operation panel in order to display processing information and the like.

Further, in the above example, a so-called column type NC planar grinding apparatus in which the column 13 is moved in the Z direction has been described as the automatic grinding apparatus 1 that is an embodiment of the present disclosure. However, the automatic grinding apparatus according to the present disclosure is not limited thereto. For example, the automatic grinding apparatus according to the present disclosure may be a so-called saddle type NC planar grinding apparatus. In this NC planar grinding apparatus, the table is moved in the Z direction by a saddle configured to be movable in the Z direction.

Further, in the above example, an NC planar grinding apparatus for grinding a main surface of a substantially plate-shaped workpiece W so that the main surface has a substantially planar shape has been described as the automatic grinding apparatus 1. However, a model of the automatic grinding apparatus according to the present disclosure is not limited thereto. For example, the automatic grinding apparatus according to the present disclosure may be a cylindrical grinding apparatus for grinding an outer circumferential surface of a substantially cylindrical workpiece W, an inner-surface grinding apparatus for grinding an inner circumferential surface, an end surface, and the like of a substantially cylindrical workpiece W, or a combined automatic grinding apparatus obtained by combining those apparatuses.

The present disclosure is not limited to the above embodiment. The present disclosure can be variously modified within the gist thereof.

Note that the automatic grinding apparatus 1 may be configured to include only the first to third operating devices (start button 42, temporary stop button 46, and emergency stop button 43) as operating devices performed by an operator. Further, the automatic grinding apparatus 1 may include the display portion 41 in addition to the first to third operating devices (start button 42, temporary stop button 46, and emergency stop button 43).

Further, in the automatic grinding apparatus 1 in the above embodiment, the reference plates 44*a* and 44*b* are provided on the table 12. However, the table 12 does not need to include the reference plates 44*a* and 44*b*.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An automatic grinding apparatus, comprising:

a grinding wheel configured to grind a workpiece having a surface to be ground;

a support configured to support the workpiece;

a feeding device configured to change a relative position between the grinding wheel and the workpiece by moving the grinding wheel or the support;

a first detector configured to detect a position of the surface of the workpiece in a cutting direction of the grinding wheel, the cutting direction being perpendicular to a rotational axis of the grinding wheel;

a second detector configured to detect a position of the surface of the workpiece in a first feeding direction and a second feeding direction, the first feeding direction being parallel to the rotational axis, the second feeding direction being perpendicular to the cutting direction and the first feeding direction;

a third detector configured to detect a position of a lower end portion of an outer circumference of the grinding wheel; and a control device configured to, before processing using the grinding wheel is started, calculate a range in which the grinding wheel and the support are relatively moved on the basis of information on the positions of the workpiece and the lower end portion of the outer circumference of the grinding wheel detected by the first detector, the second detector, and the third detector, move the grinding wheel or the support by performing numerical control with respect to the feeding device, and automatically start the processing using the grinding wheel.

2. The automatic grinding apparatus according to claim 1, further comprising an operating device through which an instruction to automatically start the processing using the grinding wheel is input, the operating device being connected to the control device.

3. The automatic grinding apparatus according to claim 1, further comprising:

a first operating device through which an instruction to automatically start the processing using the grinding wheel and an instruction to restart the processing using the grinding wheel that is temporarily stopped are input, the first operating device being connected to the control device;

a second operating device through which an instruction to temporarily stop the processing using the grinding wheel is input, the second operating device being connected to the control device; and a third operating device through which an instruction to completely stop the processing using the grinding wheel is input, the third operating device being connected to the control device.

4. The automatic grinding apparatus according to claim 1, wherein the automatic grinding apparatus includes no operation panel through which an instruction regarding processing is input to the control device.

5. The automatic grinding apparatus according to claim 1, wherein:

the control device includes a communication portion configured to transmit/receive processing information to/from an external device; and the control device is configured to transmit/receive the processing information to/from a mobile information communication terminal that communicates with the control device via the communication portion.

6. The automatic grinding apparatus according to claim 1, wherein the first detector is configured to detect a coordinate value of the surface of the workpiece in the cutting direction, the second detector is configured to detect a coordinate value of the surface of the workpiece in the first feeding direction and a coordinate value of the surface of the workpiece in the second feeding direction, and the third detector is configured to detect a coordinate value of the lower end portion of the outer circumference of the grinding wheel in the cutting direction.

7. The automatic grinding apparatus according to claim 1, wherein the control device is configured to obtain a thickness of the workpiece in the cutting direction based on the position of the surface of the workpiece in the cutting direction detected by the first detector, a size of the workpiece in the first feeding direction and the second feeding direction based on the position of the surface of the workpiece in the first feeding direction and the second feeding direction detected by the second detector, and a radius of the grinding wheel based on the position of the lower end portion of the outer circumference of the grinding wheel detected by the third detector.

8. The automatic grinding apparatus according to claim 1, wherein the grinding wheel is further configured to grind an upper surface of the workpiece.

* * * * *